US012053108B2

(12) United States Patent
Dobrusskin et al.

(10) Patent No.: US 12,053,108 B2
(45) Date of Patent: Aug. 6, 2024

(54) COVER OF A DRINKING DEVICE

(71) Applicant: KONINKLIJKE PHILIPS N.V., Eindhoven (NL)

(72) Inventors: Christoph Dobrusskin, Nuenen (NL); Amir Masoud Akbari Pazooki, Eindhoven (NL); Narasimha Shastri, Eindhoven (NL); Coen Petrus Martinus Claassen, Lommel (BE)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 318 days.

(21) Appl. No.: 17/435,566

(22) PCT Filed: Feb. 28, 2020

(86) PCT No.: PCT/EP2020/055216

§ 371 (c)(1),
(2) Date: Sep. 1, 2021

(87) PCT Pub. No.: WO2020/178154

PCT Pub. Date: Sep. 10, 2020

(65) Prior Publication Data

US 2022/0061562 A1 Mar. 3, 2022

(30) Foreign Application Priority Data

Mar. 5, 2019 (EP) ..... 19160675

(51) Int. Cl.
*A47G 19/22* (2006.01)

(52) U.S. Cl.
CPC ..... *A47G 19/2272* (2013.01)

(58) Field of Classification Search
CPC ..... A47G 19/2272
(Continued)

(56) References Cited

U.S. PATENT DOCUMENTS 5,680,951 A * 10/1997 Feltman, III ..... A47G 19/2272 220/253
5,890,619 A 4/1999 Belanger
(Continued)

FOREIGN PATENT DOCUMENTS

EP 3345514 A1 * 7/2018 ..... A47G 19/2272
EP 3345514 A1 7/2018
(Continued)

OTHER PUBLICATIONS

International Search Report and Written Opinion, International Application No. PCT/EP2020/055216, Mailed on May 20, 2020.

*Primary Examiner* — J. Gregory Pickett
*Assistant Examiner* — Niki M Eloshway

(57) ABSTRACT

A cover (12) is configured to be used with a liquid container for realizing a drinking device in conjunction with the liquid container. The cover (12) is particularly designed to prevent fluid communication therethrough in a default condition, and to allow fluid communication therethrough in an actuated condition. To that end, the cover (12) includes a gasket (30) and a cover body (20) accommodating the gasket (30), the cover body (20) comprising a liquid passage area (21) and a sealing rim (22). In order for the cover (12) to be leakproof to a high extent under all circumstances in which it is not desired to retrieve liquid through the cover (12), the gasket (30) has at least one structural feature (34) configured to secure sealing contact of the gasket (30) to the sealing rim (22) of the cover body (20) in the default condition of the cover (12).

20 Claims, 4 Drawing Sheets

(58) Field of Classification Search
USPC ..... 220/713
See application file for complete search history.

(56) References Cited

U.S. PATENT DOCUMENTS

| | | | | |
|---|---|---|---|---|
| 9,241,588 | B2 | 1/2016 | Dunn | |
| 9,801,481 | B2 | 10/2017 | Dunn | |
| 9,888,796 | B2 | 2/2018 | Dunn | |
| 2011/0084084 | A1 | 4/2011 | Berg | |
| 2013/0233870 | A1 | 9/2013 | Miller | |
| 2017/0013985 | A1 | 1/2017 | Fan | |
| 2018/0042415 | A1 | 2/2018 | Dunn et al. | |
| 2019/0159615 | A1* | 5/2019 | Maguire | B65D 47/2062 |
| 2020/0229625 | A1* | 7/2020 | Holschumacher | A47G 19/2272 |
| 2021/0068520 | A1* | 3/2021 | Chung | A45F 3/16 |
| 2023/0062840 | A1* | 3/2023 | Lane | B65D 39/088 |
| 2023/0255378 | A1* | 8/2023 | Dunn | A47G 19/2272 220/203.28 |

FOREIGN PATENT DOCUMENTS

| | | | | |
|---|---|---|---|---|
| EP | 3366167 | A1 * | 8/2018 | A47G 19/2272 |
| GB | 2401857 | A | 11/2004 | |
| WO | 2000048491 | A1 | 8/2000 | |
| WO | 2003061438 | A1 | 7/2003 | |
| WO | 2009126042 | A1 | 10/2009 | |
| WO | WO-2011020501 | A1 * | 2/2011 | A47G 19/2272 |
| WO | 2012007731 | A2 | 1/2012 | |
| WO | 2016038371 | A1 | 3/2016 | |
| WO | 2018215769 | A1 | 11/2018 | |
| WO | WO-2019110052 | A1 * | 6/2019 | A47G 19/2272 |

* cited by examiner

COVER OF A DRINKING DEVICE

CROSS-REFERENCE TO PRIOR APPLICATIONS

This application is the U.S. National Phase application under 35 U.S.C. § 371 of International Application No. PCT/EP2020/055216, filed on 28 Feb. 2020, which claims the benefit of European Patent Application No. 19160675.5, filed on 5 Mar. 2019. These applications are hereby incorporated by reference herein.

FIELD OF THE INVENTION

The invention relates to a cover that is configured to be used with a liquid container for realizing a drinking device in conjunction with the liquid container, one side of the cover being an interior side that is intended to have an interior position in the drinking device when the cover is in place on the liquid container, and another side of the cover being an exterior side that is intended to have an exterior position in the drinking device when the cover is in place on the liquid container, wherein the cover is designed to prevent fluid communication therethrough between the interior side and the exterior side in a default condition, and to allow fluid communication therethrough between the interior side and the exterior side in an actuated condition, wherein the cover includes a gasket and a cover body accommodating the gasket, the cover body comprising a liquid passage area and a sealing rim, and wherein, in the default condition of the cover, the gasket is in sealing contact to the sealing rim of the cover body through a sealing area, wherein the gasket is operable to realize a local interruption of the sealing contact of the gasket to the sealing rim of the cover body.

The invention also relates to a drinking device that comprises a liquid container and a cover of the type defined in the preceding paragraph.

BACKGROUND OF THE INVENTION

The invention is in the field of drinking devices that comprise a cover besides a liquid container, wherein the cover does not necessarily need to be provided with a spout. Such drinking devices are often used for the purpose of letting small children have a drink by themselves, as the cover serves for limiting the extent to which liquid contained in the liquid container of the drinking device is spilled when the drinking device is in the hands of a small child. In many cases, the cover includes some kind of valve that is normally closed and that can be opened under the influence of a suction force applied from outside of the drinking device, particularly a suction force applied by a person using the drinking device and putting the cover to his/her lips in order to take in liquid from the drinking device.

WO 2009/126042 A1 discloses a drinking device comprising a liquid container and a cover including a valve element and a gasket. The cover serves to prevent liquid from unintentionally pouring out of the drinking device. The valve element is provided with an abutment along a free edge portion thereof, wherein the gasket is designed to contact the abutment in a sealing fashion. A number of evenly spaced indentations on an inner cylindrical surface of the valve element end in the abutment. The valve element is further provided with a splash guard with through openings. This splash guard is designed to reduce the mass forces as may be exerted on the gasket by liquid in the liquid container in certain situations, for example, when the liquid container is shaken.

The gasket is designed from an elastic, rubberlike material and has such a shape that it is caused to lay slightly pretensioned against the abutment of the valve element. When a portion of the gasket is subjected to an external suction force at the position of the abutment, a portion of the gasket is displaced slightly off the abutment, as a result of which a distance is obtained between the gasket and the abutment that is large enough for allowing liquid to flow through one or more openings of the splash guard, a number of indentations and out between the gasket and the abutment. When the external suction force is removed, the gasket will resume its original shape so that the sealing contact of the gasket to the abutment of the valve element is completely restored.

US 2013/233870 discloses another drinking vessel design in which a sealing element has a series of parallel projections, to define a series of channels. The seal is deformed by suction at the rim of the drinking vessel so that liquid flows past the rim.

SUMMARY OF THE INVENTION

It is an object of the invention to provide a cover that is designed to prevent spillage of liquid from a drinking device in an effective manner without needing complex structural features and associated disadvantages such as complex manufacturing steps and cleaning difficulties. For example, in the above-described cover known from WO 2009/126042 A1, the splash guard is of a rather complex design, and also the need to have the indentations on the inner cylindrical surface of the valve element is disadvantageous.

The invention is defined by the claims.

In view of the desire to improve the design of a cover that is intended to be used with a liquid container and that needs to have more or less opposed functionalities of preventing a flow of liquid from the liquid container in one situation and allowing a person to drink liquid in another situation, the invention provides a cover that includes a gasket and a cover body accommodating the gasket, the cover body comprising a liquid passage area and a sealing rim, wherein, in the default condition of the cover, i.e. the condition of the cover in which fluid communication therethrough is prevented, the gasket is in sealing contact to the sealing rim of the cover body through a sealing area, wherein the gasket is operable to realize a local interruption of the sealing contact of the gasket to the sealing rim of the cover body, and wherein the gasket has at least one structural feature configured to secure the sealing contact of the gasket to the sealing rim of the cover body in the default condition of the cover.

Two main functions of the cover body are 1) accommodating the gasket and 2) covering a liquid container yet allowing fluid communication therethrough to an extent that is both i) as limited as possible for avoiding spillage and ii) sufficient for enabling a user to have a pleasant drinking experience. According to the invention, a cover body does not need to be of complex design in order to fulfill these functions. Among other things, in the cover according to the invention, it is not necessary for the cover body to have a splash guard function as known from WO 2009/126042 A1, because the gasket itself is designed to secure sealing contact of the gasket to the cover body in circumstances other than the gasket being operated by a user to assume a condition for allowing a user to take in liquid through the cover. It may be practical for both the sealing rim of the cover body and the sealing area of the gasket to be ring shaped, in which case a sealing loop is present in the cover in the default position. The ring shape and the loop may be of a continuous or an interrupted nature, and may be generally circular, but other options are feasible in this respect as well, including square and rectangular. Further, it may be practical for the gasket to be located at the exterior side of the cover, i.e. the side of the cover that is intended to have an exterior position in the drinking device when the cover is in place on the liquid container.

In particular, the structural feature of the gasket may be configured to reduce or even avoid/remove an influence of liquid pressure acting in a direction from the interior side to the exterior side on the sealing contact of the gasket to the sealing rim of the cover body should such pressure occur in the default condition of the cover. When a drinking device including a cover and containing liquid is shaken or dropped to the ground, for example, it may happen that the liquid is so vigorously moved inside the drinking device that pressure is exerted to the gasket to such an extent that the sealing contact of the gasket to the sealing rim of the cover body would be broken if is was not for counteracting measures. In the context of the invention, the counteracting measures may involve a reduction of an influence of the pressure to the sealing contact, or even avoidance/removal of such influence. For example, the counteracting measures may be aimed at realizing dissipation of the pressure, or may involve actual blockage of a flow of liquid towards the area of the sealing contact.

Dissipation of the pressure can be obtained when the structural feature of the gasket comprises channels arranged at least partially in a surface of the sealing area of the gasket. Such channels are preferably shaped and oriented so as to not hinder an outgoing flow of liquid during a drinking action, when the sealing contact of the gasket to the sealing rim of the cover body is deliberately interrupted by a user, or only hinder such outgoing flow of liquid to a minimum extent. On the other hand, such channels may be shaped and oriented to change the flow direction of a liquid that reaches the gasket in a situation in which the cover should remain closed, so that the pressure exerted by the liquid on the gasket is dissipated and thereby kept between acceptable limits for maintaining the sealing contact of the gasket to the sealing rim of the cover body. The channels may have a kinked shape for that purpose, wherein it may be so that each of the channels comprises a kink that is situated on the gasket at a position of a transition between the sealing area of the gasket and an area of the gasket skirted by the sealing area in order to use the length of the respective channels to an optimal extent and to maximize the pressure dissipating capacity of the channels. Additionally, it may be so that the gasket has at least two portions of different stiffness. For example, if the gasket has a lower stiffness in the sealing area than in an area skirted by the sealing area, liquid that should be blocked from flowing through the cover encounters a relatively stiff area of the gasket in a first instance, which is another factor contributing to dissipation of pressure in such a case.

Actual blockage of a flow of liquid towards the area of the sealing contact of the gasket to the sealing rim of the cover body is obtained by arranging the structural feature of the gasket to comprise a closure lip in an area of the gasket that is closer to the interior side of the cover than the sealing area of the gasket, wherein the cover body comprises a contacting surface area at close range from the closure lip, the contacting surface area of the cover body facing the closure lip of the gasket at a position further from the interior side of the cover than the closure lip.

By close range is meant normally spaced from the closure lip, but sufficiently close that the closure lip is able to move or deform in response to an internal overpressure sufficiently to make contact with the contacting surface area.

The closure lip may be arranged so as to project towards the cover body, or to extend more or less parallel to the contacting surface area of the cover body, for example. In any case, in the arrangement as defined, when underpressure is exerted on the gasket at the exterior side of the cover during a drinking action, liquid is free to flow towards an outlet passage created between the sealing area of the gasket and the sealing rim of the cover body as well as to pass between the closure lip of the gasket and the contacting surface area of the cover body in the process. However, when overpressure is exerted on the gasket from the other side, the closure lip is subjected to the pressure as well, which results in deformation and/or displacement of the lip. Advantageously, the design of the cover is such that the deformed and/or displaced lip is made to abut the contacting surface area of the cover body, thereby preventing the flow of liquid from reaching the area of the sealing contact of the gasket to the sealing rim of the cover body.

The lip may be arranged in the gasket in a hinged fashion, which may be achieved by having a groove in the gasket at a suitable position, for example, in which case contact of the lip to the contacting surface area of the cover body may mainly rely on a hinged displacement of the lip. Depending on the overall design of the cover, it may be practical for the closure lip to be ring shaped.

Within the framework of the invention, more examples of structural features of the gasket aimed at securing the sealing contact of the gasket to the sealing rim of the cover body in the default condition of the cover than the examples of having channels in a surface of the gasket and having a closure lip on the gasket are feasible. At least two structural features may be incorporated in the design of a single gasket. For example, a gasket comprising channels as mentioned may comprise the closure lip as mentioned as well.

Preferably, the cover comprises only a minimum number of components. In this respect, it is noted that the cover body may be a single integral entirety, and that the cover may be composed of no more than the cover body and the gasket.

The gasket may be held in the cover body in any possible suitable way. According to one practical possibility, the cover body comprises an inwardly projecting rib, wherein the gasket comprises a groove accommodating a portion of the inwardly projecting rib of the cover body, and wherein the rib may be provided with one or more liquid passage openings. According to another/additional practical possibility, the gasket is connected to the cover body through one of a peripheral screw connection, bayonet connection or snap connection, the connection being adapted to allow liquid to pass, i.e. the connection being designed so as to be a leaking connection. The extent to which liquid is allowed to pass the connection, can be carefully chosen so as to have a useful compromise between the desire to have a leakproof cover on the one hand and to allow a person to retrieve liquid through the cover on the other hand, and the connection can easily be realized in accordance with any choice that is made in this respect. According to yet another/additional practical possibility, the cover body comprises a generally cup-shaped recessed portion accommodating the gasket, and an undercut knob at a bottom position of the generally cup-shaped recessed portion, wherein the gasket comprises a portion engaging the undercut knob.

It is practical for the gasket to have flexible properties and in view thereof, the gasket may be at least partially made of a flexible material. A feasible example of a suitable flexible material in this context is silicone.

The invention also relates to a drinking device that comprises a liquid container and a cover as defined and described in the foregoing. The liquid container and the cover may be joined in any possible suitable way in order to realize an assembled state of the drinking device. For example, the cover and the liquid container may be attachable to each other and detachable from each other through screw thread.

The above-described and other aspects of the invention will be apparent from and elucidated with reference to the following detailed description of two embodiments of a cover of a drinking device, the design of the cover having aspects aimed at improving the extent to which the cover is leakproof.

BRIEF DESCRIPTION OF THE DRAWINGS

The invention will now be explained in greater detail with reference to the figures, in which equal or similar parts are indicated by the same reference signs, and in which.

DETAILED DESCRIPTION OF EMBODIMENTS

Figure 1:
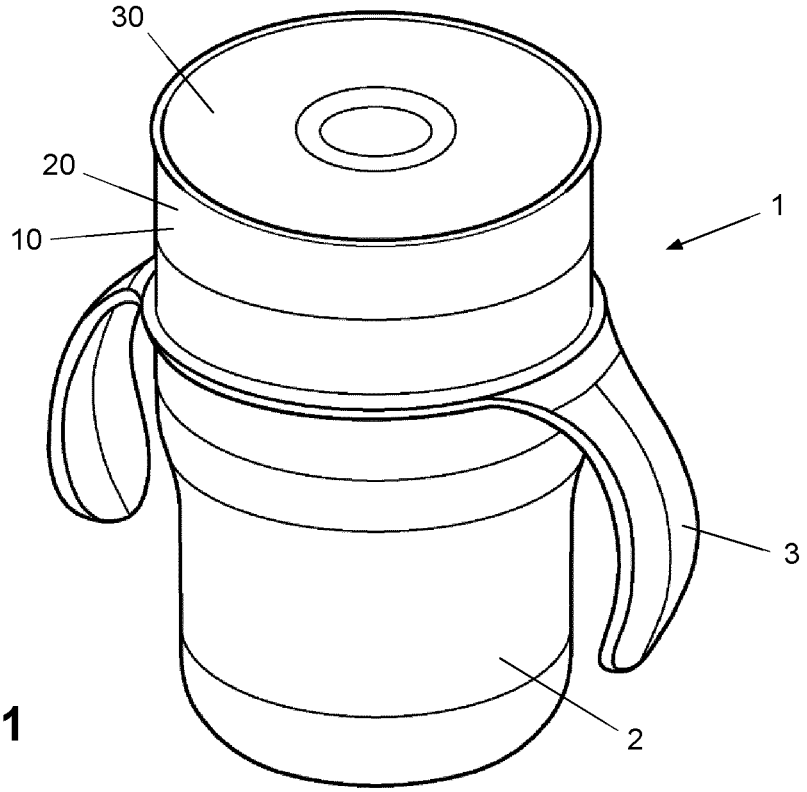
FIG. 1 diagrammatically shows a perspective view of a drinking device including a liquid container and a cover, illustrating an assembled state of the drinking device, FIG. 2 relates to a first embodiment of a cover according to the invention and diagrammatically shows a sectional view of a portion of the cover, illustrating a default condition of the cover, FIGS. 3 and 4 relate to the first embodiment of the cover according to the invention and illustrate features of a surface of a sealing area of a gasket that is part of the cover, FIG. 5 relates to a second embodiment of a cover according to the invention and diagrammatically shows a sectional view of the cover, illustrating a default condition of the cover, FIG. 6 relates to the second embodiment of the cover according to the invention and shows a perspective view of a cover body that is part of the cover, and FIG. 7 serves to illustrate a practical way in which components of the cover according to the invention can be connected to each other.

The invention relates to a cover for use in a drinking device. FIG. 1 diagrammatically shows a general example of a drinking device 1 including a cup-shaped liquid container 2 and a cover 10. In the figure, the drinking device 1 is shown in an assembled state, i.e. a state in which the cover 10 is in place on the liquid container 2 for covering an open side of the liquid container 2. The liquid container 2 serves for containing liquid that is intended to be drunk by a user of the drinking device 1. The cover 10 is designed to assume one of two conditions, one condition being a default condition in which the cover prevents fluid communication therethrough between the one side and the other, on the basis of which a closed condition of the drinking device 1 is realized, and another condition being an actuated condition in which the cover 10 allows fluid communication therethrough between the one side and the other, on the basis of which a condition of the drinking device 1 in which liquid can be supplied to a user is realized.

One side of the cover 10 is an interior side that has an interior position in the drinking device 1 in the assembled state of the drinking device 1, and another side of the cover 10 is an exterior side that has an exterior position in the drinking device 1 in the assembled state of the drinking device 1. It follows from the foregoing that in the default condition of the cover 10, a flow of liquid through the cover 10, from the interior side of the cover 10 to the exterior side of the cover 10, is prevented, while in the actuated condition of the cover 10, liquid is allowed to pass through the cover 10, from the interior side of the cover 10 to the exterior side of the cover 10.

Basically, the cover 10 comprises a cover body 20 and a gasket 30 that is accommodated by the cover body 20. The actuated condition of the cover 10 is obtained on the basis of action taken by a user, in particular when a user has placed his/her lips at a portion of an exterior peripheral rim of the cover 10 and subjects the portion to a suction force. When the cover 10 is in the actuated condition, the liquid can be retrieved from the drinking device 1 by tilting the drinking device 1 to an appropriate extent. For the sake of completeness, it is noted that in the shown example, the cover 10 is of the spoutless type.

The cover body 20 may be made of a suitable rigid plastic, while the gasket 30 may at least partially be made of a suitable flexible material such as silicone. The gasket 30 may be coupled to the cover body 20 in any suitable way. Generally speaking, the gasket 30 may have a disc-shaped appearance, or, depending on the dimensions of the gasket 30 in the direction of a central axis thereof, a tray-shaped or cup-shaped appearance. In the shown example, both the cover body 20 and the gasket 30 have a substantially circular periphery.

FIG. 1 illustrates the fact that the drinking device 1 may include a handle 3 for the purpose of facilitating handling of the drinking device 1 by a user. The handle 3 can be integrally formed with either the liquid container 2 or the cover 10, or can be a separate component that is attachable to and detachable from the liquid container 2 or the cover 10, and that is to be put in place by a user in a process of putting the drinking device 1 to the assembled state.

Figure 2:
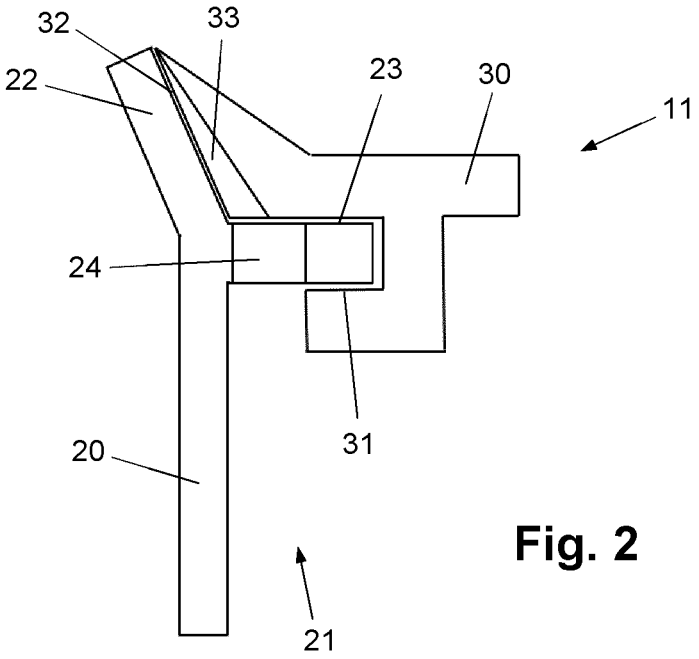
Figure 3:
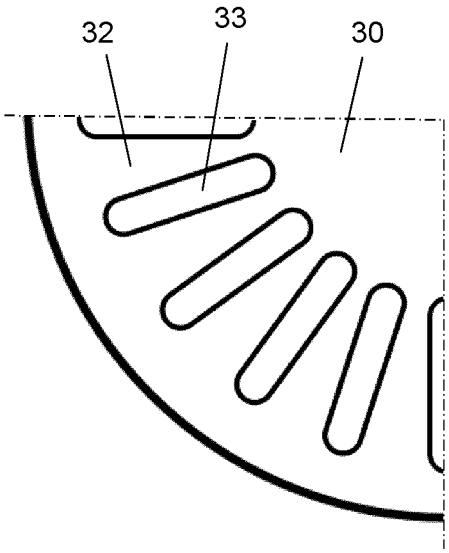
Figure 4:
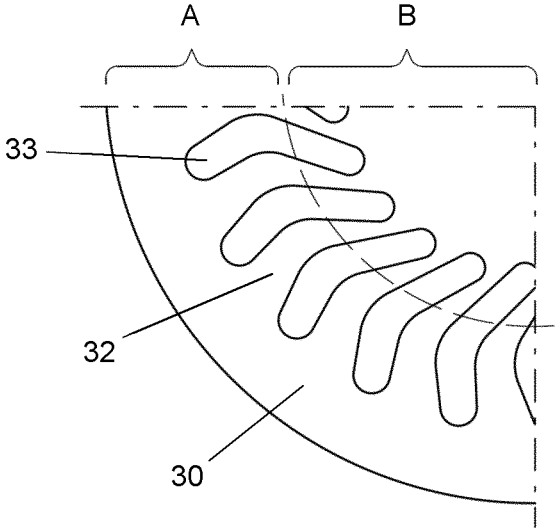

FIGS. 2-4 relate to a first embodiment of a cover 11 according to the invention, and details of the cover 11 are now described, wherein it is to be noted that the details are not to be understood so as to be limiting to the invention, and wherein it is further to be noted that details which may be considered independently by a skilled person are not to be understood so as to be inextricably correlated even though they are disclosed with reference to a single example, unless an indication to the contrary is explicitly given. The cover 11 is intended to be used in a drinking device 1 as generally described in the foregoing with reference to FIG. 1, and includes a cover body 20 and a gasket 30 as mentioned. In FIG. 2, it is shown that the cover body 20 comprises a liquid passage area 21 and a ring-shaped sealing rim 22.

In the shown example, the cover body 20 comprises a ring-shaped inwardly projecting rib 23, and the gasket 30 comprises a ring-shaped groove 31 accommodating a portion of the inwardly projecting rib 23 of the cover body 20. Hence, the rib 23 has a function in supporting the gasket 30 in the cover body 20. Further, in the shown example, the liquid passage area 21 of the cover body 20 includes at least one liquid passage opening 24 in the rib 23. Although it is possible to have only one liquid passage opening 24 in the rib 23, it is preferred if there are at least two liquid passage openings 24 which are dimensioned and distributed so as to cover most of the periphery of the cover body 20, so that a user is free to choose any peripheral position on the cover 11 for placing his/her lips on the cover 11 in the case that the cover 11 is used in a drinking device 1 and a user wants to drink from the drinking device 1.

In the default condition of the cover 11, the gasket 30 is in sealing contact to the sealing rim 22 of the cover body 20 through a ring-shaped sealing area 32. In this way, it is achieved that in the default condition of the cover 11, the cover 11 is closed, so that in a drinking device 1 that is in an assembled state and that includes the cover 11, liquid as may be present in the liquid container 2 of the drinking device 1 is blocked from flowing from the drinking device 1. When the cover 11 is put to the actuated condition, the sealing contact of the gasket 30 to the sealing rim 22 of the cover body 20 is interrupted, as a result of which a passage for liquid through the cover 11 is obtained in the cover 11. In conformity with what has been explained earlier, an interruption of the sealing contact is obtained under the influence of a suction force exerted by a user. With reference to FIG. 2, it is noted that such a suction force causes the gasket 30 to be locally lifted from the sealing rim 22 of the cover body 20.

The fact that an interruption of the sealing contact of the gasket 30 to the sealing rim 22 of the cover body 20 is obtained under the influence of a suction force exerted by a user implies that the design of the cover 11 is such that a liquid passage is opened through the cover 11 when underpressure is exerted at the exterior side of the cover 11. A technical difficulty arises from the fact that the situation of an underpressure being exerted at the exterior side of the cover 11 resembles a situation of an overpressure being exerted at the interior side of the cover 11, and that the latter situation may actually occur as well, namely in case a drinking device 1 in which the cover 11 is used contains liquid and is shaken or experiences a mechanical shock from falling down or being slammed on a table or the like with much force. The invention is aimed at securing the sealing contact of the gasket 30 to the sealing rim 22 of the cover body 20 in such situations of interior overpressure, without compromising the functionality of the cover 11 in respect of the capability to allow for an interruption of the sealing contact in situations of exterior underpressure. To that end, the invention provides at least one particular structural feature at the very level of the gasket 30.

According to a first option, the invention involves the presence of channels 33 in the gasket 30, particularly in a surface of the gasket 30 facing the cover body 20, the surface as mentioned including both a surface portion of the sealing area 32 of the gasket 30 and a surface portion of an area of the gasket skirted/encompassed by the sealing area 32. In this respect, it is noted that FIGS. 3 and 4 show a quarter portion of the gasket 30, in a view on the surface as mentioned, so that the channels 33 can be seen. The channels 33 are shaped and oriented in such a way that an outgoing flow of liquid is possible at the position of an interruption of the sealing contact of the gasket 30 to the sealing rim 22 of the cover body 20 when a portion of the gasket 30 is lifted under the influence of an external suction force exerted on the portion by a user. However, if the sealing contact of the gasket 30 to the sealing rim 22 of the cover body 20 is uninterrupted and liquid is made to press against the gasket 30, which may happen when the cover 11 is in place on a liquid container 2 containing liquid and the drinking device 1 including both the liquid container 2 and the cover 11 is shaken or dropped, for example, as explained earlier, the channels 33 have a pressure dissipating effect, so that the sealing contact can be maintained.

FIG. 4 serves to illustrate that it may be beneficial for the channels 33 to have a kinked shape. In the figure, two sections A and B are indicated, separated by a dashed line, wherein section A is a ring-shaped area of the gasket 30 that is in a position for covering a liquid container 2 when the cover 11 is part of a drinking device 1 in an assembled state, and wherein section B is the sealing area 32 of the gasket 30. Advantageously, the stiffness of the gasket 30 is higher in section A than in section B, which may be achieved by having larger thickness and/or using fixture elements in section A, for example. In that case, it is preferred if the stiffness in section B decreases in an outward direction. In the configuration shown in FIG. 4, the channels 33 are only partially exposed to the liquid in section A, and are shaped and oriented so as to curve sideways in the sealing area 32 of the gasket 30. As a result, if underpressure is exerted at the exterior side of the cover 11, the gasket 30 is locally lifted from the sealing rim 22 of the cover body 20, in which case liquid can flow freely through the channels 33, as explained earlier. However, when the sealing contact between the gasket 30 and the sealing rim 22 of the cover body 20 is uninterrupted and liquid is forced towards the gasket 30, the liquid is guided into the channels 30 and is forced to move sideways, so that the pressure exerted by the liquid on the gasket 30 is effectively dissipated and the liquid is prevented from pushing the gasket 30 away to such an extent that the sealing contact is broken. Thus, by applying a relatively uncomplicated measure, namely by providing the gasket 30 with an appropriate pattern of channels 33, it is achieved that the extent to which the cover 11 is leakproof is increased without making it harder for a user to retrieve liquid through the cover 11 by exerting a suction force on the cover 11.

Figure 5:
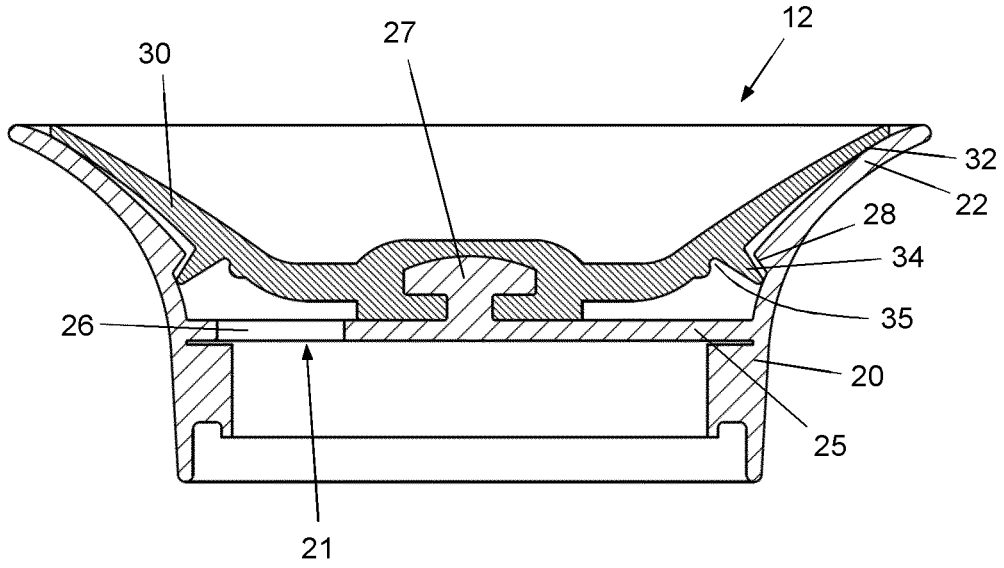
Figure 6:
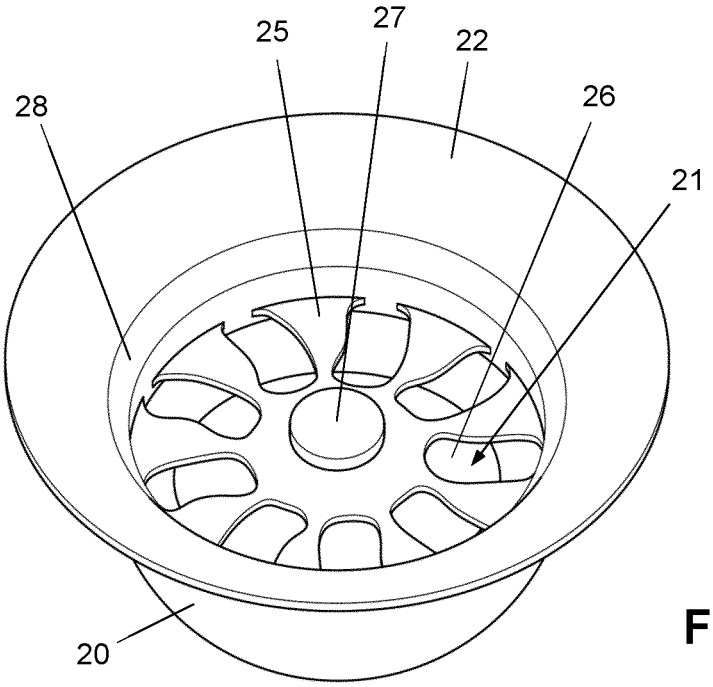

FIGS. 5 and 6 relate to a second embodiment of a cover 12 according to the invention, and details of the cover 12 are now described, wherein it is to be noted that the details are not to be understood so as to be limiting to the invention, and wherein it is further to be noted that details which may be considered independently by a skilled person are not to be understood so as to be inextricably correlated even though they are disclosed with reference to a single example, unless an indication to the contrary is explicitly given. The cover 12 is intended to be used in a drinking device 1 as generally described in the foregoing with reference to FIG. 1, and includes a cover body 20 and a gasket 30 as mentioned.

As is the case with the cover 11 according to the first embodiment, the cover body 20 comprises a liquid passage area 21 and a ring-shaped sealing rim 22. A difference to the cover 11 according to the first embodiment resides in the fact that the cover body 20 includes a disc-shaped portion 25 having liquid passage openings 26, and that in the shown example, the disc-shaped portion 25 of the cover body 20 is equipped with an undercut knob 27 for the purpose of mounting the gasket 30, wherein a portion of the gasket 30 engages the undercut knob 27. Further, as is the case with the cover 11 according to the first embodiment, the gasket 30 comprises a ring-shaped sealing area 32, wherein the gasket 30 contacts the sealing rim 22 of the cover body 20 through the sealing area 32 in a default condition of the cover 12, such that uninterrupted sealing contact of the gasket 30 to the sealing rim 22 of the cover body 20 is obtained, and wherein the sealing contact can be interrupted at a position where a user exerts a suction force on the cover 12 in order to put the cover 12 to an actuated condition and enable a passage of liquid therethrough so that a drinking action can take place, as the gasket 30 can be made to locally flex away from the sealing rim 22 of the cover body 20 in such a situation.

In FIG. 5, it can be seen that at a level between 1) a level of sealing contact between the gasket 30 and the sealing rim 22 of the cover body 20 and 2) a level of the disc-shaped portion 25 of the cover body 20, the gasket 30 has a ring-shaped closure lip 34 projecting outwardly from the gasket 30. Further, the cover body 20 comprises a contacting surface area 28 at close range from the closure lip 34. In particular, the closure lip 34 of the gasket 30 is at a level closer to the level of the disc-shaped portion 25 of the cover body 20 than the contacting surface area 28 of the cover body 20. Also, the closure lip 34 of the gasket 30 comprises flexible material and is hingably arranged in the gasket 30, the gasket 30 being provided with a groove 35 at a suitable position for allowing a hinging movement of the closure lip 34 towards the contacting surface area 28 of the cover body 20. In this configuration, when the cover 12 is put from the default condition to the actuated condition by a user, nothing happens that may influence the positioning of the closure lip 34 of the gasket 30 and the contacting surface area 28 of the cover body 20 with respect to each other, so that in such a case, liquid can freely pass between the closure lip 34 of the gasket 30 and the contacting surface area 28 of the cover body 20. However, if liquid pressure is exerted from the level of the disc-shaped portion 25 of the cover body 20 to the level of sealing contact between the gasket 30 and the sealing rim 22 of the cover body 20, the closure lip 34 of the gasket 30 is pressed against the contacting surface area 28 of the cover body 20, as a result of which the liquid is not capable of passing between the gasket 30 and the cover body 20. Thus, by applying a relatively uncomplicated measure, namely by providing the cover 12 with the combination of the closure lip 34 of the gasket 30 and the contacting surface area 28 of the cover body 20, it is achieved that the extent to which the cover 12 is leakproof is increased without making it harder for a user to retrieve liquid through the cover 12 by exerting a suction force on the cover 12.

Figure 7:
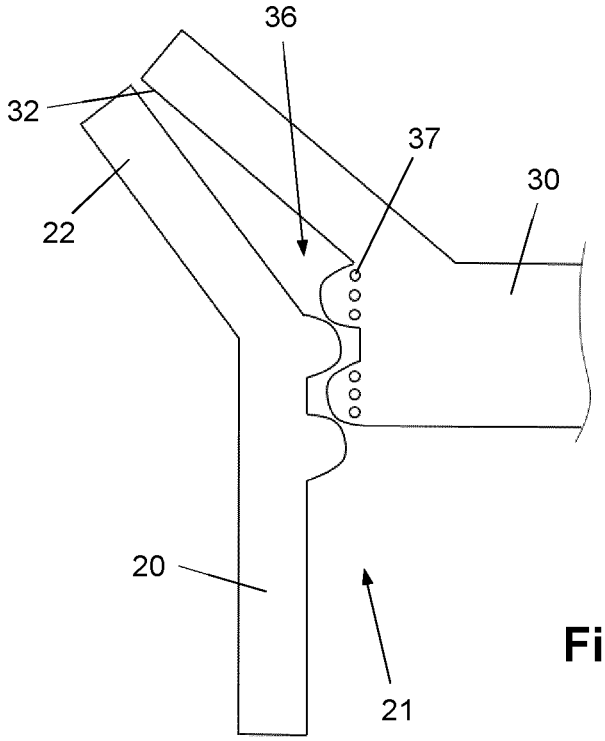

FIG. 7 illustrates another practical way of holding the gasket 30 in the cover body 20 than relying on a rib/groove connection and/or knob-based engagement as mentioned in the foregoing. The fact is that it may be practical for the gasket 30 and the cover body 20 to be interconnected through a peripheral screw connection 36. In such a case, for the purpose of preventing the peripheral screw connection 36 from totally blocking a liquid flow, it is advantageous if the screw connection 36 is designed such as to be of a leaking type. For example, the screw connection 36 may be designed so as to allow liquid to pass between the respective screw threads on the gasket 30 and the cover body 20 and/or may include liquid passage openings 37 in at least one of the respective screw threads.

It is noted that the two main design features described above, namely the channels in the first examples and the closure lip in the second example, may be both be used in another example of the cover.

It will be clear to a person skilled in the art that the scope of the invention is not limited to the examples discussed in the foregoing, but that several amendments and modifications thereof are possible without deviating from the scope of the invention as defined in the attached claims. It is intended that the invention be construed as including all such amendments and modifications insofar they come within the scope of the claims or the equivalents thereof. While the invention has been illustrated and described in detail in the figures and the description, such illustration and description are to be considered illustrative or exemplary only, and not restrictive. The invention is not limited to the disclosed embodiments. The drawings are schematic, wherein details which are not required for understanding the invention may have been omitted, and not necessarily to scale.

Variations to the disclosed embodiments can be understood and effected by a person skilled in the art in practicing the claimed invention, from a study of the figures, the description and the attached claims. In the claims, the words "comprising" and "including" do not exclude other steps or elements, and the indefinite article "a" or "an" does not exclude a plurality. Any reference signs in the claims should not be construed as limiting the scope of the invention.

Elements and aspects discussed for or in relation with a particular embodiment may be suitably combined with elements and aspects of other embodiments, unless explicitly stated otherwise. Thus, the mere fact that certain measures are recited in mutually different dependent claims does not indicate that a combination of these measures cannot be used to advantage.

The terms "comprise" and "include" as used in this text will be understood by a person skilled in the art as covering the term "consist of". Hence, the term "comprise" or "include" may in respect of an embodiment mean "consist of", but may in another embodiment mean "contain/have/be equipped with at least the defined species and optionally one or more other species".

In respect of the adjective "ring-shaped" as used in the description of possible embodiments of the cover 10, 11, 12 according to the invention in respect of both the sealing rim 22 of the cover body 20 and the sealing area 32 of the gasket 30, it is noted that this is to be understood so as to imply that a closed loop is realized in a case of uninterrupted contact between the sealing rim 22 of the cover body 20 and the sealing area 32 of the gasket 30, wherein the loop can have any appropriate shape. Hence, in the context of the invention, the term "ring-shaped" does not necessarily imply a circular shape of the sealing contact, although this is one of the practical options. For example, a square shape, a rectangular shape or a D shape are also possible.

Notable aspects of the invention can be summarized as follows. A cover 10, 11, 12 is configured to be used with a liquid container 2 for realizing a drinking device 1 in conjunction with the liquid container 2. The cover 10, 11, 12 is particularly designed to prevent fluid communication therethrough in a default condition, and to allow fluid communication therethrough in an actuated condition. To that end, the cover 10, 11, 12 includes a gasket 30 and a cover body 20 accommodating the gasket 30, the cover body 20 comprising a liquid passage area 21 and a sealing rim 22, wherein, in the default condition of the cover 10, 11, 12, the gasket 30 is in sealing contact to the sealing rim 22 of the cover body 20 through a sealing area 32, and wherein the gasket 30 is operable to realize a local interruption of the sealing contact of the gasket 30 to the sealing rim 22 of the cover body 20. In order for the cover 10, 11, 12 to be leakproof to a high extent under all circumstances in which it is not desired to retrieve liquid through the cover 10, 11, 12, the gasket 30 has at least one structural feature 33, 34 configured to secure sealing contact of the gasket 30 to the sealing rim 22 of the cover body 20 in the default condition of the cover 10, 11, 12.

The invention claimed is:

1. A cover configured to be used with a liquid container for realizing a drinking device in conjunction with the liquid container, the cover comprising:

having an interior position in the drinking device when the cover is in place on the liquid container, an exterior side having an exterior position in the drinking device when the cover is in place on the liquid container, a gasket comprising at least one structural feature including a closure lip; and a cover body accommodating the gasket, the cover body comprising a liquid passage area, a sealing rim and a contacting surface area, wherein, in a default condition of the cover, the gasket is in sealing contact to the sealing rim of the cover body through a sealing area, preventing fluid communication between the interior side and the exterior side, wherein, in an actuated condition of the cover, the gasket is operable to locally flex away from the sealing rim to realize a local interruption of the sealing contact of the gasket to the sealing rim of the cover body, allowing the fluid communication between the interior side and an exterior side through the local interruption, wherein the at least one structural feature of the gasket is configured to secure the sealing contact of the gasket to the sealing rim of the cover body in the default condition of the cover, wherein the closure lip is positioned in an area of the gasket that is closer to the interior side of the cover than the sealing area, and wherein the contacting surface area of the cover body is configured to face the closure lip of the gasket at a position further from the interior side of the cover than the closure lip, such that the closure lip is adapted to press against the contacting surface area for increasing an extent to which the cover is leakproof.

2. The cover according to claim 1, wherein the closure lip is arranged in the gasket in a hinged fashion.

3. The cover according to claim 1, wherein the at least one structural feature of the gasket is configured to at least reduce an influence of liquid pressure acting in a direction from the interior side to the exterior side on the sealing contact of the gasket to the sealing rim of the cover body when such pressure occurs in the default condition of the cover.

4. The cover according to claim 1, wherein the structural feature of the gasket comprises channels arranged at least partially in a surface of the sealing area of the gasket.

5. The cover according to claim 4, wherein the channels have a kinked shape.

6. The cover according to claim 5, wherein each of the channels comprises a kink that is situated on the gasket at a position of a transition between the sealing area of the gasket and an area of the gasket skirted by the sealing area.

7. The cover according to claim 4, wherein the gasket has at least two portions of different stiffness.

8. The cover according to claim 1, wherein the cover body is a single integral entirety, and wherein the cover is composed of no more than the cover.

9. The cover according to claim 1, wherein the cover body comprises an inwardly projecting rib, and wherein the gasket comprises a groove accommodating a portion of the inwardly projecting rib of the cover body.

10. The cover according to claim 1, wherein the gasket is connected to the cover body through one of a peripheral screw connection, bayonet connection or snap connection, the connection being adapted to allow liquid to pass.

11. The cover according to claim 1, wherein the cover body comprises a generally cup-shaped recessed portion accommodating the gasket, and an undercut knob at a bottom position of the generally cup-shaped recessed portion, and wherein the gasket comprises a portion engaging the undercut knob.

12. The cover according to claim 1, wherein the gasket is at least partially made of a flexible material.

13. A drinking device, comprising the liquid container and the cover according to claim 1.

14. The drinking device according to claim 13, wherein the cover and the liquid container are attachable to each other and detachable from each other through screw thread.

15. The cover according to claim 1, wherein, in the actuated condition of the cover, the gasket is operable to locally flex away from the sealing rim under influence of a suction force exerted by a user.

16. A cover configured to be used with a liquid container for realizing a drinking device in conjunction with the liquid container, the cover comprising:

an interior side having an interior position in the drinking device when the cover is in place on the liquid container;

an exterior side having an exterior position in the drinking device when the cover is in place on the liquid container, wherein the cover is configured to prevent fluid communication therethrough between the interior side and the exterior side in a default condition, and to allow the fluid communication therethrough between the interior side and the exterior side in an actuated condition;

a gasket comprising at least one structural feature including a closure lip and a plurality of channels; and a cover body accommodating the gasket, the cover body comprising a liquid passage area, a sealing rim and a contacting surface area, wherein, in the default condition of the cover, the gasket is in sealing contact to the sealing rim of the cover body through a sealing area, wherein the gasket is operable to realize a local interruption of the sealing contact of the gasket to the sealing rim of the cover body, wherein the at least one structural feature of the gasket is configured to secure the sealing contact of the gasket to the sealing rim of the cover body in the default condition of the cover, wherein the closure lip is positioned in an area of the gasket that is closer to the interior side of the cover than the sealing area of the gasket, wherein each channel of the plurality of channels has a kinked shape, and is arranged at least partially in a surface of the sealing area of the gasket, and wherein the contacting surface area of the cover body is configured to face the closure lip of the gasket at a position further from the interior side of the cover than the closure lip, such that the closure lip is adapted to press against the contacting surface area for increasing an extent to which the cover is leakproof.

17. The cover according to claim 16, wherein each channel of the plurality of channels comprises a kink that is situated on the gasket at a position of a transition between the sealing area of the gasket and an area of the gasket skirted by the sealing area.

18. A drinking device, comprising:

a liquid container configured to hold a liquid; and a cover configured to connect to the liquid container to prevent fluid communication between an interior side of the cover and exterior side of the cover when the cover is in a default condition, and to allow the fluid communication between the interior side and the exterior side of the cover when the cover is in an actuated condition, wherein the cover comprises:

a gasket comprising a closure lip, and a cover body accommodating the gasket, the cover body comprising a liquid passage area, a sealing rim and at least one contacting surface area, wherein, in the default condition of the cover, the gasket is in sealing contact to the sealing rim of the cover body through a sealing area, preventing the fluid communication between the interior side and the exterior side, wherein, in the actuated condition of the cover, the gasket is operable to locally lift from the sealing rim to realize a local interruption of the sealing contact of the gasket to the sealing rim of the cover body, allowing the fluid communication between the interior side and the exterior side through the local interruption, wherein the closure lip is positioned in an area of the gasket that is closer to the interior side of the cover than the sealing area, and wherein the contacting surface area of the cover body is configured to face the closure lip of the gasket at a position further from the interior side of the cover than the closure lip, such that fluid is able to pass between the closure lip and the contacting surface area when the cover transitions from the default condition to the actuated condition, and the closure lip is configured to press against the contacting surface area for increasing an extent to which the cover is leakproof when liquid pressure is exerted by the fluid from the interior side when the cover is in the default condition.

19. The drinking device according to claim 1, wherein, in the actuated condition of the cover, the gasket is operable to locally lift from the sealing rim under influence of a suction force exerted by a user.

20. The drinking device according to claim 19, wherein the gasket further comprises a plurality of channels arranged at least partially in a surface of the sealing area of the gasket, and configured to enable an outgoing flow of the fluid at the local interruption of the sealing contact of the gasket to the sealing rim of the cover body.

* * * * *